US006269556B1

(12) United States Patent
Källqvist

(10) Patent No.: US 6,269,556 B1
(45) Date of Patent: Aug. 7, 2001

(54) BLADE HOLDER FOR A SNOW-CLEARING DEVICE

(75) Inventor: Gösta Källqvist, Hunnebostrand (SE)

(73) Assignee: AB Mähler & Söner, Rosson (SE)

( * ) Notice: Subject to any disclaimer, the term of this patent is extended or adjusted under 35 U.S.C. 154(b) by 0 days.

(21) Appl. No.: 09/331,898

(22) PCT Filed: Jan. 9, 1998

(86) PCT No.: PCT/SE98/00024

§ 371 Date: Jul. 9, 1999

§ 102(e) Date: Jul. 9, 1999

(87) PCT Pub. No.: WO98/30756

PCT Pub. Date: Jul. 16, 1998

(30) Foreign Application Priority Data

Jan. 9, 1997 (SE) ..... 9700046

(51) Int. Cl.[7] ..... E01H 5/06

(52) U.S. Cl. ..... 37/233; 37/270; 37/282; 403/24; 403/220

(58) Field of Search ..... 403/24, 220, 225, 403/291, 404; 37/266, 270, 279, 282, 233; 404/6

(56) References Cited

U.S. PATENT DOCUMENTS 3,465,456 * 9/1969 Meyer ..... 37/279 X
4,249,357 * 2/1981 Cornou ..... 404/6 X
4,899,472 * 2/1990 Winter ..... 37/270
5,638,617 * 6/1997 Belanger et al. ..... 37/270

FOREIGN PATENT DOCUMENTS 25 52 058 5/1977 (DE) .
42 04 109 8/1993 (DE) .
95/23894 9/1995 (WO) .

* cited by examiner

*Primary Examiner*—Harry C. Kim
(74) *Attorney, Agent, or Firm*—Jacobson Holman, PLLC

(57) ABSTRACT

The invention relates to a holder for connecting a blade (7) to the lower edge (6) of a snow-clearing device, such that the blade is given an acute, cutting angle to the base and can be folded backwards, thereby avoiding damage when running into an obstacle, and automatically resume its cutting angle after passing the obstacle. The holder comprises a trilateral hollow beam (1), the three sides of the beam forming respectively: a first fixing element (3) which is adapted to be fixed to the lower edge (6) of the snow-clearing device; a second fixing element (4) which is adapted to engage the back of the blade (7), and a support element (5) connecting the other two elements (3, 4). At least the second fixing element (4) and the support element (5) are made of an elastic polymer material. The hollow beam is adapted to fix the blade along a line along the lower part of the second fixing element (4) close to a corner of the beam, and the elastic elements (4, 5) are adapted, on overloading, to be buckled, the support element (5) being buckled towards the cavity (2) of the beam, and the second fixing element (4) being buckled forwards/upwards.

20 Claims, 2 Drawing Sheets

BLADE HOLDER FOR A SNOW-CLEARING DEVICE

BACKGROUND OF THE INVENTION

1. Field of the Invention

The invention relates to a holder for connecting a blade to the lower edge of a snow-clearing device, such that the blade is given a cutting (acute) angle to the base and can be folded backwards, thereby avoiding damage when running into an obstacle, and automatically resume its cutting angle after passing the obstacle.

2. Description of the Related Art

In the first place, the invention is intended for use on a snow-clearing device comprising a plough wing, snow scraper or snow blade which is supported by a vehicle or device carrier of some type and which in its lower part has at least one blade serving to engage the ground with its cutting edge and ensure a snow-cutting and snow-raising action. Use is normally made of a plurality of relatively short blades which are mounted side by side along the lower edge of the snow-clearing device.

It is desirable that the device can remove substantially all loose snow lying on a roadway, i.e. as far as possible also snow lying in cavities in the form of e.g. ruts in the roadway, to provide a safe base. This means that the blades of the snow-clearing device must be able to operate in close engagement with the roadway, which can be achieved if they are flexibly fixed to the lower part of the plough and thus can be individually inclined in the lateral direction relative to the lower part of the plough. It is also desirable that the device can cut or scrape away snow or ice adhering to the roadway. Moreover, it should be possible to carry out the above-mentioned snow-clearing work at high speed. It goes without saying that snow-clearing under these conditions subjects both the snow-clearing device and the device carrier to heavy stress, and they can be damaged if the blade strikes against a stationary obstacle, for instance, protruding gutters, kerbs, and railway tracks.

To protect the device and the device carrier against damage arising in case of running into an obstacle, it is previously known to mount the blade to be pivotable backwards, against the action of a spring, about a hinge located above the blade. In this case, the blade must be essentially vertically oriented to the roadway, thereby making it possible for the lower edge of the blade to move backwards/upwards without causing a lifting motion of the device. It is not possible to position the blade at an evidently positive angle relative to the vertical plane, i.e. with the lower edge of the blade extended forwards in the travelling direction. With this design, the blade therefore operates with a scraping effect against the roadway, thereby making it necessary to press the blade against the roadway relatively firmly to ensure good snow-clearing results. The construction also results in the snow-throwing ability being limited.

A prior-art arrangement for protecting devices and device carriers when the blade is oriented at an acute, cutting angle to the roadway is disclosed in International Patent Application WO 95/23894. The blade is hingedly attached to the front end of a forwardly extended pivot arm. When running into an obstacle, the blade can, against the action of a spring, be folded backwards while at the same time the pivot arm is raised against the action of another spring. In this construction, the blade has a positive angle relative to the vertical plane and also vertical flexibility relative to the roadway. However, a drawback is the fact that the blades cannot be inclined in the lateral direction and, thus, do not achieve the flexibility that is required to obtain a good snow-clearing effect on a rutted roadway. Besides, the mechanical construction requires much repair and maintenance since it is subjected to heavy wear and is easily damaged in this environment.

SUMMARY OF THE INVENTION

An object of the present invention is to provide an improved blade holder of the type mentioned by way of introduction, i.e. which is adapted to orient the blade at an acute, cutting angle to the roadway and which has an automatic folding back effect when running into an obstacle. A further object is to provide a blade holder which under all snow-clearing conditions gives the blades good flexibility and close engagement with the roadway, i.e. also on roadways with ruts and ridges. One more object is to provide a simple, robust and light construction which has no mechanical hinges. It should be possible to use the same type of blade holder for all types of snow-clearing devices which are provided with blades, e.g. front mounted ploughs, side wing ploughs, rear mounted ploughs, snow scrapers and blades mounted underneath, which makes it possible for the user of the device to simplify and standardise his stock-keeping of wearing parts and spare parts.

These and other objects and advantages, which will appear from the following specification, are achieved by a holder as defined in the claims.

The inventive holder comprises a trilateral hollow beam, the three sides of the beam forming respectively: a first fixing element (3) which is adapted to be fixed to the lower edge (6) of the snow-clearing device; a second fixing element (4) which is adapted to engage the back of the blade (7), and a support element (5) connecting the other two elements (3, 4) to a triangular cross-section of the hollow beam (1), at least the second fixing element (4) and the support element (5) being made of an elastic polymer material ensuring that each element, i.e. each side of the hollow beam, is resilient in the transverse direction and bendable about its longitudinal direction; and means for attaching the blade to the hollow beam (1). The holder is characterised in that the hollow beam (1) has such a shape that, when mounted against the lower edge (6) of the device, the second fixing element (4) and the support element (5) are directed obliquely downwards/forwards and meet in a corner in front of the lower edge (6) of the device; that the hollow beam is adapted to fix the blade along a line along the lower part of the second fixing element (4) close to said corner of the beam, the second fixing element (4) and the support element (5), in operation of the device, exerting on the blade a pressure spring action directed obliquely downwards/forwards, and that said elements (4, 5) are adapted, on overloading, to buckle, the support element (5) being adapted to buckle towards the cavity (2) of the beam, and the second fixing element (4) being adapted to buckle forwards/upwards.

Preferably, the trilateral hollow beam has the same length as the blade that has been chosen. Normally, each blade consists of a section of 600–1800 mm, and a plurality of such sections are arranged side by side along the lower edge of the plough.

The invention is based on the idea of forming of a flexible material a blade holder which operates as pressure springs over the length of the blade and presses the blade in its direction of engagement against the roadway, thereby making it possible for the blade to follow the roadway in the vertical direction and to be automatically inclined in the lateral direction for close engagement in ruts and on ridges in the roadway.

The blade holder orients the blade at an acute, cutting angle relative to the roadway, which results in good clearing and snow-throwing ability. The blade is folded backwards when striking against stationary obstacles such as gutters, kerbs etc. and automatically resumes its operating position after passing the obstacle. This is achieved by the second fixing element and the support element being adapted to be folded (buckled) when subjected to an overloading pressure, such that the blade is temporarily folded backwards and then is moved back to its operating position by the elasticity of the elements.

BRIEF DESCRIPTION OF THE DRAWINGS

An embodiment of the invention will now be described in more detail with reference to the accompanying drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
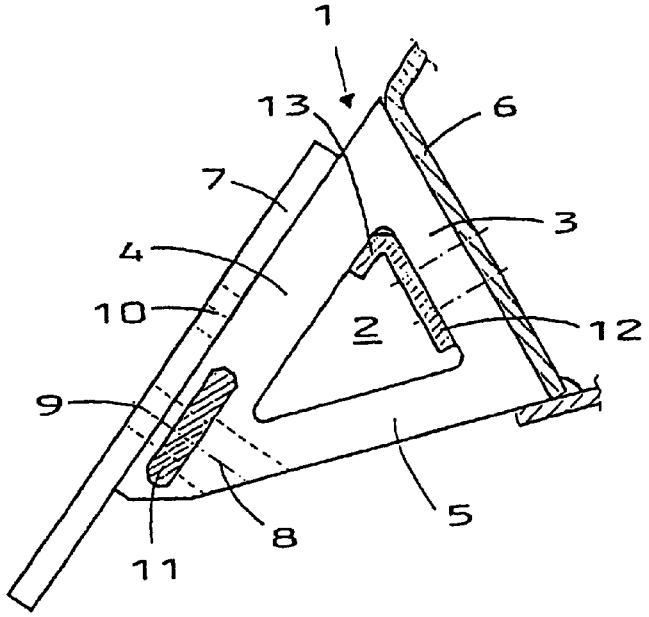
FIG. 1 is a side view, in section, of a blade holder according to the invention with a mounted blade and attached to the lower edge of a plough.

FIG. 1 thus shows a holder according to the invention, comprising a trilateral hollow beam 1 with an inner cavity 2, the three sides of the beam forming: a first fixing element 3, a second fixing element 4 and a support element 5, respectively.

The first fixing element 3 is fixed to the lower edge 6 of the snow-clearing device. This edge is adjusted to the hollow beam to give a surface of attachment which is suitable in respect of size and angle, for instance, by a bent edge on the lowermost part of a plough blade.

At least the second fixing element 4 and the support element 5 are made of an elastic polymer material which ensures that each element, i.e. hollow beam side, is resilient in the transverse direction and bendable about its longitudinal direction. Many different types of elastomers which are resistant to loads are conceivable as polymer materials, e.g. urethane rubber or some other type of rubber material. Polyurethane is a preferred type of material.

The first fixing element 3 may consist of, for example, a steel sectional element, the other two elements being fixed to the steel sectional element so as to form a hollow beam. However, it is preferred to form the entire hollow beam in one piece of the same elastic polymer material, as shown in the Figures. It is particularly preferred to cast the hollow beam in e.g. urethane rubber. The urethane rubber should then have a hardness of at least 50° Shore A and, in many applications, preferably at least 70° Shore A.

The second fixing element 4 acts as a mounting for a blade 7. This side of the hollow beam thus engages the back of the blade and is in its lower part formed with holes 8 for detachable fixing of the blade. The attachment line of the blade thus is relatively close to a corner of the hollow beam. The material between the attachment line of the blade and the lower edge 6 of the device serves as pressure springs which are distributed over the entire length of the blade and press the blade in its direction of engagement against the roadway. The attachment of the blade can be effected in a conventional manner by means of, for instance, a key and a key bolt, and the blade may be of a reversible type with pairs of fixing holes 9 and 10.

To avoid cracking around the holes 8, the second fixing element 4 is provided with a reinforcing steel bar 11, which is embedded in the elastic polymer material and extends along the element 4 in the area of attachment of the blade in the hollow beam.

The third side of the hollow beam, the support element 5, connects the other two elements to a triangular cross-section of the hollow beam and acts as a spring holding the blade in place when affected by the friction against the roadway, and also when the blade is inclined in the lateral direction, as described in connection with FIGS. 4 and 4*a*.

The blade holder 1 can be fixed to the lower edge of the snow-clearing device by means e.g. bolt joints. When the first fixing element 3 is made of a polymer material, a reinforcing steel bar 12 is arranged on the back of the fixing element in the cavity 2 of the beam. In the embodiment shown in the Figures, the steel bar 12 has a downwardly bent portion 13 along its one long side. The portion 13 extends a distance along the back of the adjoining second fixing element 4 and serves to stabilise this element and control the direction of buckling, as described in connection with FIG. 3.

Figure 2:
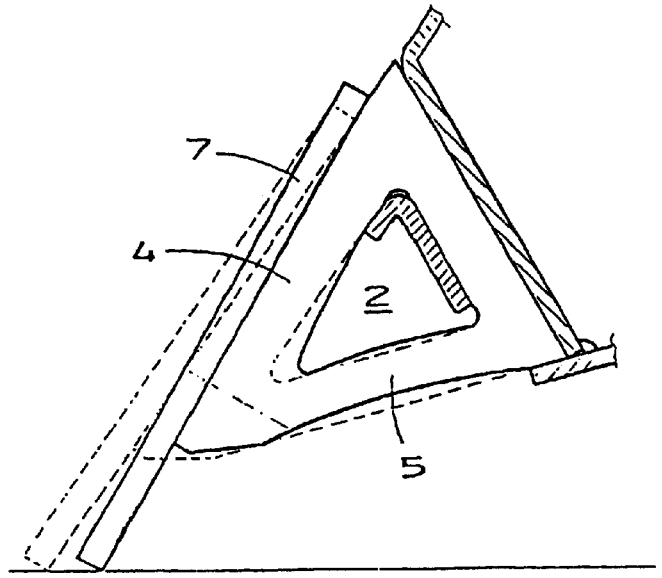
FIG. 2 shows the same blade holder subjected to load owing to friction against the roadway.

FIG. 2 shows the behaviour of the blade holder during operation of the snow-clearing device. When clearing snow, friction develops between the blade and the roadway and the blade is pressed slightly backwards. The support element 5 acts as a spring and is compressed, and the motion makes it slightly curved upwards towards the cavity 2 of the beam. This curvature controls the direction of the buckling that is to happen when the blade strikes against an obstacle which may cause damage to the device and the device holder.

Figure 3:
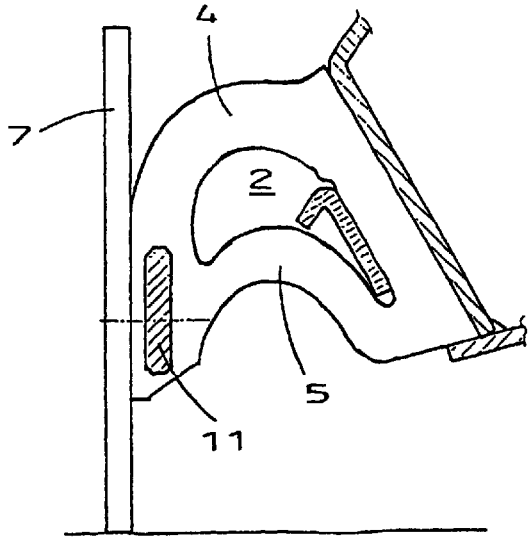
FIG. 3 shows the same blade holder when the blade strikes against an obstacle.

FIG. 3 shows the situation in which the blade strikes against an obstacle. The support element 5 will then be buckled upwards while at the same time the fixing element 4 is buckled forwards/upwards owing to the upwardly directed force generated by the blade when being raised vertically. The motion is reinforced by a turning moment forming around the attachment line of the blade at the steel bar 11. The blade achieves a dragging angle. After passing the obstacle, the blade holder springs back to its operating position.

Figure 4:
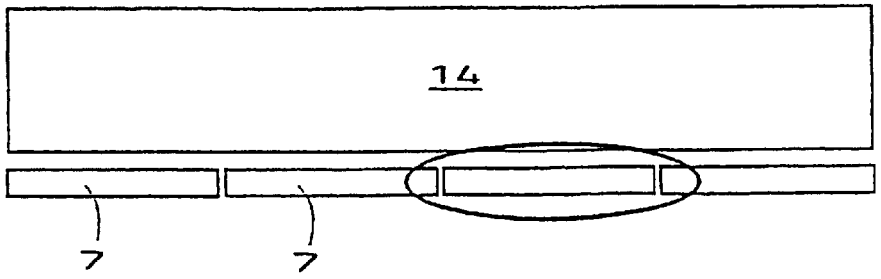
FIG. 4 shows a plough wing with a plurality of juxtaposed blades.
Figure 4A:
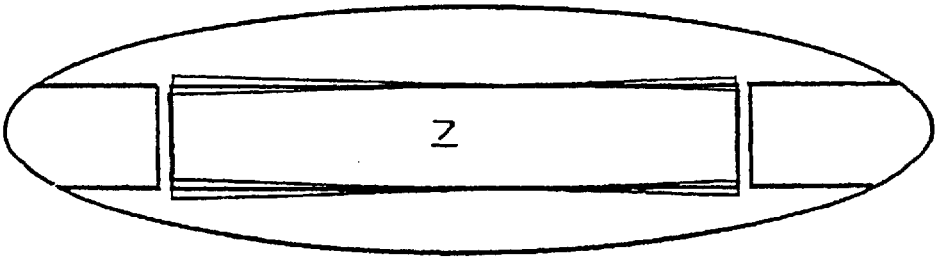
FIG. 4*a* is an enlarged view of a blade in FIG. 4.

FIG. 4 is a schematic view of a plough blade 14, to the lower edge of which a number of blades 7 are mounted side by side. Each blade can be mounted with a blade holder which has a length corresponding to the length of the blade. In the operating position, the blades should have a pressure of engagement against the roadway to allow efficient clearing of snow. This means that the second fixing element 4 is compressed while at the same time the support element 5 is compressed owing to the friction when advancing the device. The force which thus is built up in the elements 4 and 5 will incline the blade in the lateral direction as shown in FIG. 4*a* if the roadway has ruts or ridges.

The good flexibility of the blades against the roadway increases the clearing effect and means that the blades require but a small pressure against the roadway to achieve satisfactory engagement, which in turn reduces blade wear and power consumption in the snow-clearing work. The simple and robust construction minimises repairs and maintenance, and the low weight reduces the weight of the device, which is of special importance to front mounted ploughs which are to be transported in an uplifted position and thus load the front axle of the device carrier. The flexible fixing of the blades also reduces noise and vibrations, which, inter alia, creates a better working environment for the driver and reduces damage to the device and the device holder owing to vibrations.

The invention being thus described, it will be obvious that the same may be varied in many ways. Such variations are not to be regarded as a departure from the spirit and scope of the invention, and all such modifications as would be recognized by one skilled in the art are intended to be included within the scope of the following claims.

What is claimed is:

1. A snow-clearing device having a lower edge disposed above a ground surface when operating the device, a blade mounted to said lower edge at an acute, cutting angle to the ground, and a holder connecting said blade to said lower edge such that said blade can be folded backwards, thereby avoiding damage when running into an obstacle, and automatically resume its cutting angle after passing the obstacle, said holder comprising a trilateral hollow beam having three sides defining a central cavity, said three sides of the beam forming respectively:

a first fixing element which is fixed to said lower edge of the snow-clearing device;

a second fixing element which engages a back of the blade; and a support element connecting the first fixing element and the second fixing element to a triangular cross-section of the beam said second fixing element and said support element being made of an elastic polymer material ensuring that said second fixing element and said support element are each resilient in a transverse direction and bendable about a longitudinal directione, said hollow beam having such a shape that, when mounted against the lower edge of the device, the second fixing element and the support element are directed obliquely downwards and forwards and meet in a corner in front of the lower edge of the device, said blade being fixed to said beam along a line along a lower part of said second fixing element close to said corner of the beam, said second fixing element and said support element, in operation of the device, exerting on the blade a pressure spring action directed obliquely downwards and forwards, said second fixing element and said support element buckling in response to overloading, said support element buckling towards the cavity of the beam, and said second fixing element buckling forwards and upwards.

2. The snow-clearing device of claim 1, wherein the blade is attached to said second fixing element by a steel bar which is arranged along the lower part of the second fixing element.

3. The snow-clearing device of claim 2, wherein said steel bar is embedded in the elastic polymer material.

4. The snow-clearing device of claim 1, wherein said first fixing element includes a steel sectional element, to which the second fixing element and the support element are fixed.

5. The snow-clearing device of claim 1, wherein said hollow beam in its entirety is made of the elastic polymer material.

6. The snow-clearing device of claim 5, wherein said holder further comprises a reinforcing steel bar arranged on an inner edge of the first fixing element in the cavity of the beam.

7. The snow-clearing device of claim 6, wherein said reinforcing steel bar along one side has a downwardly bent portion, which extends a distance along an inner edge of the adjoining second fixing element.

8. The snow-clearing device of claim 1, wherein said elastic polymer material is a polyurethane.

9. The snow-clearing device of claim 8, wherein said elastic polymer material is a urethane rubber with a hardness of at least 50° Shore A.

10. The snow-clearing device of claim 9, wherein said urethane rubber has a hardness of at least 70° Shore A.

11. The combination of a blade and a holder for connecting said blade to a snow-clearing device having a lower edge disposed above a ground surface when operating the device, said blade mounted to said lower edge at an acute, cutting angle to the ground, and said holder connecting said blade to said lower edge such that said blade, when running into an obstacle, can pivot backward and flex upward to avoid damage thereto, and automatically resume its cutting angle after clearing the obstacle, said holder comprising a trilateral structure with three sides defining a central cavity, said three sides including a first fixing element fixed to said lower edge of the device, a second fixing element which engages the blade, and a support element connecting the first fixing element and the second fixing element, said second fixing element and said support element being directed obliquely downwards and forwards and meeting in a corner in front of the lower edge of the device, said blade being fixed to said second fixing element along only an attachment line close to said corner, each of said second fixing element and said support element being made of an elastic polymer material such that each is resilient in a transverse direction and bendable along a longitudinal edge, said second fixing element and said support element exerting on the blade a pressure spring-action directed obliquely downwards and forwards during operation of the device and, in response to overloading of the blade, buckling such that a respective longitudinal edge of said support element buckles upward into the central cavity of said trilateral structure, and a respective longitudinal edge of said second fixing element buckles forward and upward, said blade pivoting along the attachment line and moving upward with said attachment line without upward movement of the lower edge of the device.

12. The snow-clearing device of claim 11, wherein the blade is attached to said second fixing element by a steel bar which is arranged along a lower part of the second fixing element close to said corner.

13. The snow-clearing device of claim 12, wherein said steel bar is embedded in the elastic polymer material.

14. The snow-clearing device of claim 11, wherein said first fixing element is a steel sectional element, to which the second fixing element and the support element are fixed.

15. The snow-clearing device of claim 11, wherein all three sides of said holder are made of the elastic polymer material.

16. The snow-clearing device of claim 15, wherein said elastic polymer material is a polyurethane.

17. The snow-clearing device of claim 16, wherein said elastic polymer material is a urethane rubber with a hardness of at least 50° Shore A.

18. The snow-clearing device of claim 15, wherein said holder further comprises a reinforcing steel bar arranged on an inner edge of the first fixing element along the cavity.

19. The snow-clearing device of claim 18, wherein said reinforcing steel bar has along one side a downwardly bent portion, which extends a distance along an inner edge of the adjoining second fixing element.

20. A snow-clearing device having a lower edge disposed above a ground surface when operating the device, a blade mounted to said lower edge at an acute, cutting angle to the ground, and a holder connecting said blade to said lower edge such that said blade, when running into an obstacle, can pivot backward and flex upward to avoid damage thereto, and automatically resume its cutting angle after clearing the obstacle, said holder comprising a trilateral structure with three sides defining a central cavity, said three sides including a first fixing element fixed to said lower edge of the snow-clearing device, a second fixing element which engages the blade, and a support element connecting the first fixing element and the second fixing element, said second fixing element and said support element being directed obliquely downwards and forwards and meeting in a corner in front of the lower edge of the device, said blade being fixed to said second fixing element only along an attachment line close to said corner, each of said second fixing element and said support element being made of an elastic polymer material such that each is resilient in a transverse direction and bendable along a longitudinal edge, said second fixing element and said support element exerting on the blade a pressure spring-action directed obliquely downwards and forwards during operation of the device and, in response to overloading of the blade, buckling such that a respective longitudinal edge of said support element buckles toward the central cavity, and a respective longitudinal edge of said second fixing element buckles forward and upward, allowing the blade to pivot along the attachment line and move upward with said attachment line without upward movement of the lower edge of the device.

* * * * *